US006880767B2

(12) United States Patent
Herhold

(10) Patent No.: US 6,880,767 B2
(45) Date of Patent: Apr. 19, 2005

(54) TWO TRIGGER SAFETY CIRCUIT FOR WATER CLEANING LANCE

(75) Inventor: Matthew O. Herhold, Fenton, MI (US)

(73) Assignee: NLB Corp., Wixom, MI (US)

( * ) Notice: Subject to any disclaimer, the term of this patent is extended or adjusted under 35 U.S.C. 154(b) by 169 days.

(21) Appl. No.: 10/350,889

(22) Filed: Jan. 24, 2003

(65) Prior Publication Data

US 2004/0144855 A1 Jul. 29, 2004

(51) Int. Cl.[7] ..... B05B 9/00

(52) U.S. Cl. ..... 239/124; 239/114; 239/118; 239/123; 137/465; 137/15.04

(58) Field of Search ..... 239/114, 124; 137/465; 134/48, 148

(56) References Cited

U.S. PATENT DOCUMENTS 2,138,279 A * 11/1938 Kneisley ..... 200/183
4,538,142 A * 8/1985 Hamilton et al. ..... 340/667
4,678,892 A * 7/1987 Finger et al. ..... 392/396
4,716,401 A * 12/1987 Wohlford et al. ..... 340/568.8
5,069,391 A * 12/1991 Seasholtz ..... 239/332
5,904,297 A * 5/1999 Kendrick et al. ..... 239/124
5,938,472 A * 8/1999 Yuen et al. ..... 439/509

* cited by examiner

*Primary Examiner*—David A. Scherbel
*Assistant Examiner*—James S. Hogan
(74) *Attorney, Agent, or Firm*—Carlson, Gaskey & Olds

(57) ABSTRACT

A two-handle cleaning lance includes a pair of switches which must be held closed by an operator to allow high pressure water to be directed to a discharge nozzle. A dump valve is selectively actuated to dump the high pressure water to a dump nozzle at which it will enter the environment at a much reduced pressure. The dump valve is operated by a control which monitors that the two switches are both held closed. If either switch is released, then the dump valve is moved to a dump position. The present invention ensures that an operator does not disable one of the two switches such as by taping it closed. The dump valve will not move back to its actuated position until both switches have been released and have moved to an open position.

7 Claims, 2 Drawing Sheets

TWO TRIGGER SAFETY CIRCUIT FOR WATER CLEANING LANCE

BACKGROUND OF THE INVENTION

This invention relates to an improvement in safety circuits for cleaning lances which utilize high pressure water, and which require a pair of trigger circuits to be held closed in order to direct the water against the surface to be cleaned.

In the prior art, high pressure water is often utilized to clean surfaces. As an example, paint, dirt and other sludge may be removed from a surface by jetting high pressure water out of a hand-held cleaning lance. Typically, the cleaning lances are provided with triggers which must be held closed in order for the high pressure fluid to be directed outwardly of the lance. If the trigger is released, then a mechanical connection within the lance moves to open a dump valve, and direct the high pressure water to a dump outlet at which it is allowed to leave the lance at a reduced pressure.

The trigger ensures the high pressure water is stopped when cleaning is to be interrupted, and also provides a safety benefit in that the lance must be held in the hand of a user with the trigger closed for the high pressure water to be directed outwardly of the lance. This reduces the likelihood of high pressure water being directed in undesired directions if the lance were dropped.

More recently, there have been two innovations to this type of cleaning lance. In a first innovation, a pair of triggers are provided on the lance. The two trigger lances require the operator to have the lance firmly held in two hands, with both triggers closed. If either trigger is opened, then the valve opens. An example prior two trigger lance is shown in U.S. Pat. No. 5,904,297, which is owned by the assignee of the present invention.

One other recent innovation is the replacement of the mechanical connection with electric trigger switches. A control monitors whether the trigger switches are closed, and opens the dump valve should a trigger switch be released. The electronics necessary for the operation of such a valve are known in this art.

One problem with the above-discussed two trigger devices is that users have sometimes tried to circumvent the "double" trigger safety function. In the past, users have been known to tape one of the triggers closed such that the lance need not be held in both hands firmly. This obviously defeats the purpose of the two-switch safety device.

SUMMARY OF THE INVENTION

In the disclosed embodiment of this invention, a control for a lance monitors whether the two triggers in a two-switch safety circuit are being operated by an operator, or whether one of them appears to be blocked closed. If one of the two switches appears to be blocked closed, then the control will not allow the dump valve to close until the switch appears to again be functioning properly.

In a disclosed embodiment of this invention, the two triggers are electric switches. A control monitors the opening and closing of the switches. If one of the two switches is open, and the other is not, the dump valve is opened. This is consistent with the prior art, wherein the dump valve is opened whenever one of the two switches is released. However, and contrary to the prior art, the dump valve is not allowed to close until both triggers have been opened.

Consider a situation such as has occurred in the prior art where one of the two switches is taped closed. When the other switch is released, the dump valve is opened. The control will not close the dump valve until the taped closed switch is also released, or opened. If an operator has taped one of the two switches closed, the control will not allow the dump valve to close until that taped closed switch has opened.

In a preferred embodiment, the switches are electric switches and the dump valve is electrically controlled. A controller is preferably mounted remote from the lance, and appropriate circuitry communicates the switches to the controller, and the controller back to the dump valve.

Various sequences of operation the switches may also be required in order to close the dump valve.

These and other features of the present invention may be best understood from the following specification and drawings, the following of which is a brief description.

DETAILED DESCRIPTION OF A PREFERRED EMBODIMENT

Figure 1A:
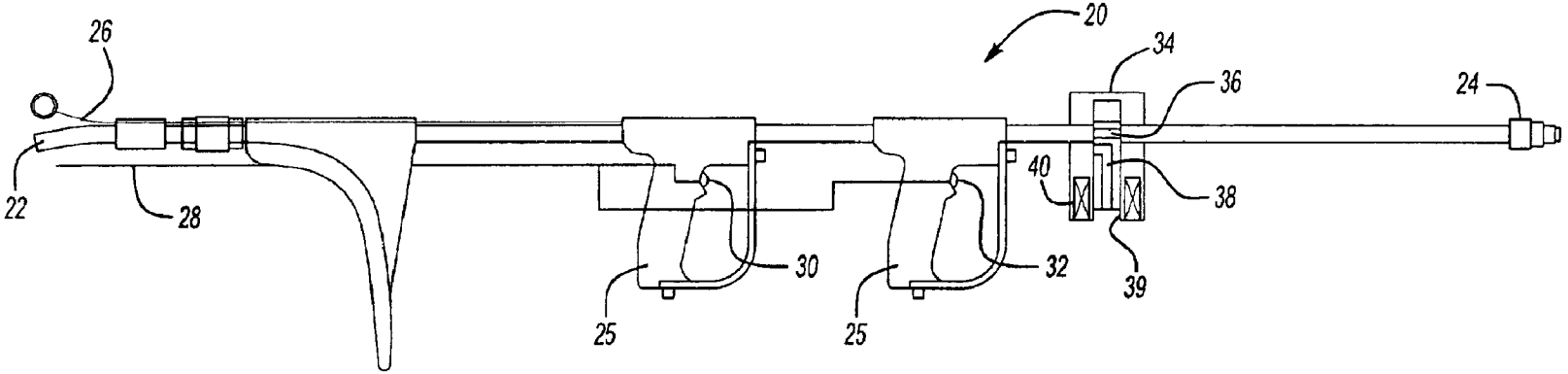
FIG. 1A is a view of a cleaning lance incorporating the present invention.
Figure 1B:
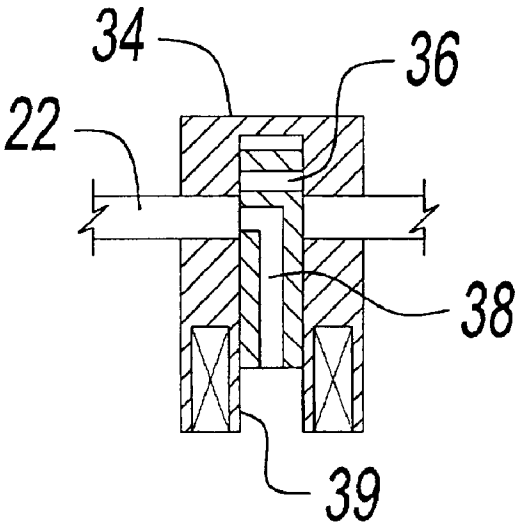
FIG. 1B shows the dump valve in the dump position.

As shown in FIG. 1A, the cleaning lance 20 has a pipe 22 for receiving the high pressure water, and delivering the high pressure cleaning water outwardly of a nozzle 24. As is known, the operator holds the nozzle such as by handles 25 to direct the water at an appropriate location. The pipe 22 end wire hose braid acts as the ground, shown schematically at 26, while a control wire 28 extends along the pipe 22. The location of the wires, and the controller would generally be known to a worker of ordinary skill in the art. It is the actual control features which are inventive here. As is known, the handles 25 typically incorporate trigger switches 30 and 32. The switches 30 and 32 operate in conjunction with the control to control a dump valve 34. Typically if either switch 30 or 32 is released, then the dump valve 34 is opened. In FIG. 1A, the dump valve 34 is shown schematically, and in its operative position within a passage 36 communicates the high pressure water through to the nozzle 24. However, should either switch 30 or 32 be opened, then a coil 40 would drive the valve 34 to a position shown in FIG. 1B such that passage 38 is aligned with the pipe 22 and the water is dumped outwardly through a dump nozzle 39. The triggers 30 and 32 thus allow an operator to control the jetting of the high pressure water outwardly of the nozzle 24. Again, the nozzle may be generally as known. It is shown here in highly schematic form.

It should be understood that the water is typically delivered at extremely high pressures which could be somewhat dangerous if the water were directed against undesired surfaces. Thus, the switches 30 and 32 not only allow the operator to stop the flow of high pressure water, but also provide a safety function, such as if the lance were dropped.

As mentioned above, it has been the case in certain circumstances that one of the two switches 30 or 32 have been taped or otherwise held closed by an operator who would like to hold the lance with a single hand. The present invention addresses this concern.

Figure 2:
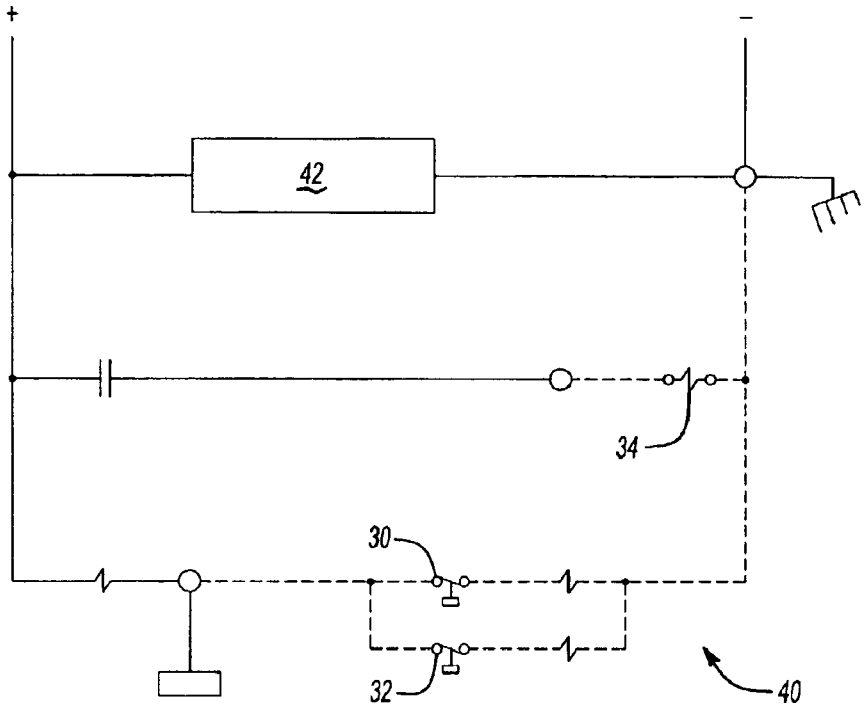
FIG. 2 is a simplified schematic of the control circuit of this invention.

As is shown in FIG. 2, a control circuit 40 has the two switches 30 and 32 in parallel. The control 42 receives a signal indicating whether one switch, both switches or neither switch is open. The control 42 is operative to open or close the valve 34 based upon the signal received from the circuit, and due to the open or closed positions of the switches 30 and 32. The voltages seen by the control will vary dependent on whether both switches are closed, both open, or either open. The control details necessary for the control 42 to identify the status of each switch is well within the skill of a worker in this art.

Figure 3:
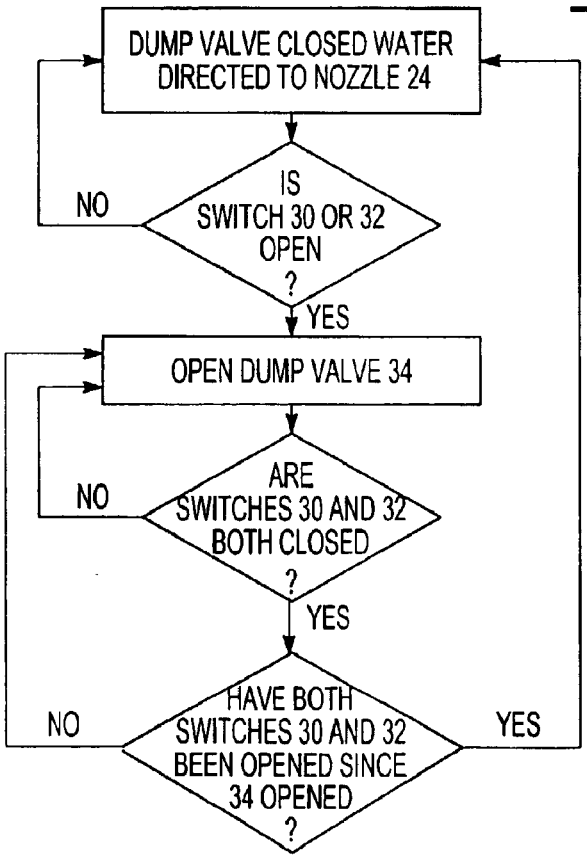
FIG. 3 is a flow chart.

The control 42 preferably operates according to a flow chart such as shown in FIG. 3. As shown, at step 1, the valve 34 is held closed with water being directed toward the nozzle. However, should one or both of the two switches be opened, then the valve is driven to the dump position. Once in the dump position, the control will only move the valve to the closed or operative position if both trigger switches have been held open and then closed. If only one has been opened, then the dump valve will not be moved to its operative position.

In this way, should an operator tape one of the two switches 30 or 32 closed, the system will not operate to direct high pressure fluid until the tape is removed. While the term "taped" has been utilized, any other way of trying to deactivate one of the two safety switches, would come within the scope of this invention. Moreover, various sequences of control of the two switches may be incorporated into the control to provide further levels of safety.

Generally, should an operator release one of the two triggers, the operator would know that the other trigger must also be released to then allow the dump valve to move back to the operative position once both figures are closed. Various sequences of closing of the two triggers could be required to provide further control over the closing of the valve.

While a preferred embodiment of this invention has been disclosed, a worker of ordinary skill in this art would recognize that certain modifications would come within the scope of this invention. Thus, the following claims should be studied to determine the true scope and content of this invention.

What is claimed is:

1. A method of operating a high pressure lance comprising the steps of:

(1) providing a high pressure cleaning lance including two handles with two trigger switches, a dump valve and an outlet nozzle, said dump valve moving between an operative position and a released position, said trigger switches having a closed and a release position, with said dump valve being moved to said dump position if either of said triggers move to said released position;

(2) communicating high pressure water to said dump valve;

(3) monitoring whether both switches are maintained held closed, and opening said dump valve if either of said switches is released, said opened dump valve dumping the high pressure fluid away form said discharge nozzle;

(4) monitoring whether both switches have been released after step 3; and not moving said dump valve back to a closed position unless both switches have been released.

2. A method as set forth in claim 1, wherein a control for monitoring movement of said switches is mounted remote from said lance.

3. A method as set forth in claim 1, wherein said switches, said control, and said dump valve are all electronic components.

4. A method of controlling a two-trigger handle cleaning lance comprising the steps of:

(1) providing a cleaning lance having a pair of handles, each of said handles having a switch which could be held closed, or released, a dump valve, a discharge nozzle, and a control;

(2) operating said dump valve to open and direct water away from said discharge nozzle should either of said switches, or both of said switches be released, and (3) not allowing said dump valve to be moved back to an operative position at which it directs high pressure water to said discharge nozzle if one of two said switches has been held closed.

5. A two-handle fluid cleaning lance comprising:

a supply pipe for receiving a high pressure fluid;

a pair of handles, each of said handles having a trigger which can be held closed or released;

a dump valve for alternatively moving between an actuated and a dump position, said dump valve being operable to allow high pressure water to be directed to a discharge nozzle in said actuated position, or dumped to the environment in said dump position; and a control for ensuring said dump valve will not be moved from a dump position back to an actuated position if either of said switches has been held closed.

6. A cleaning lance as recited in claim 5, wherein both of said switches are electric switches, and said control is an electric control for controlling said dump valve.

7. A cleaning lance as recited in claim 6, wherein said control ensures that both of said switches have been opened after said dump valve has moved from said actuated position to a dump position before allowing said dump valve to move back to said actuated position.

* * * * *

UNITED STATES PATENT AND TRADEMARK OFFICE

CERTIFICATE OF CORRECTION

PATENT NO. : 6,880,767 B2
DATED : April 19, 2005
INVENTOR(S) : Herhold, Matthew O.

It is certified that error appears in the above-identified patent and that said Letters Patent is hereby corrected as shown below:

Column 3,
Line 49, please replace “release” with -- released --
Line 50, please replace “dump” with -- released --
Line 51, please replace “triggers” with -- trigger switches --

Column 4,
Line 1, please add -- trigger -- before “switches”
Line 2, please replace “opening” with -- moved -- and -- to said released position -- before “if”
Line 3, please delete “opened”
Line 4, please replace “form” with -- form -- and please replace “discharge” with -- outlet --
Line 5, please add -- in said released position -- after “nozzle”
Line 6, please add -- trigger -- after “both”
Line 8, please replace “a closed” with -- said operative --
Lines 11 and 13, please add -- trigger -- before “switches”
Line 33, please replace “trigger” with -- switch --
Lines 36 and 37, please replace “actuated” with -- operative --
Line 39, please replace “actuated” with -- operative --
Line 42, please replace “a” with -- the --

Signed and Sealed this

Twelfth Day of July, 2005

JON W. DUDAS
*Director of the United States Patent and Trademark Office*